US005486064A

United States Patent [19]

Schulte

[11] Patent Number: 5,486,064

[45] Date of Patent: Jan. 23, 1996

[54] SOAP GRIP FOR BATHING

[76] Inventor: Eugene L. Schulte, 8301 16½ Mile Rd., Sterling Heights, Mich. 48312

[21] Appl. No.: 306,682

[22] Filed: Sep. 15, 1994

[51] Int. Cl.[6] ..... A47K 7/03

[52] U.S. Cl. ..... 401/201

[58] Field of Search ..... 401/201

[56] References Cited

U.S. PATENT DOCUMENTS

| | | | |
|---|---|---|---|
| 1,386,041 | 8/1921 | Wilson | 401/201 |
| 1,993,174 | 3/1935 | Le Coney | 401/201 |
| 2,006,708 | 7/1935 | Benedict | 401/201 |
| 2,470,851 | 5/1949 | Hermanson | 401/201 |
| 2,574,854 | 11/1951 | West | 401/201 |
| 2,829,392 | 4/1958 | Dupuy | 401/201 |
| 3,711,889 | 1/1973 | Jennings . | |
| 4,159,883 | 7/1979 | Mizell | 401/201 |
| 4,190,550 | 2/1980 | Campbell | 401/201 X |
| 4,240,760 | 12/1980 | Levine | 401/201 |
| 4,789,262 | 12/1988 | Sanchez . | |

*Primary Examiner*—Steven A. Bratlie
*Attorney, Agent, or Firm*—Robbins & Robbins

[57] ABSTRACT

A soap grip to prevent dropping the soap when bathing is provided. This is effected by sandwiching a soap bar between two or more pieces of cloth, preferably a polyester felt. The polyester felt is sewn or heat sealed together near the center in a U-shaped pocket with one end open to receive the soap bar leaving flaps at the outside of the pocket. The perimeter of the outwardly extending flaps of the soap grip is not sewn to allow more efficient soap flow through the material. The polyester felt around the soap bar provides a good grip, prevents dropping and is soft, stretchable and drapeable. This cloth allows good sudsing as the material was designed to provide flow through the thickness even when under pressure. In use, the soap grip retains the bar of soap as it is used up and ensures that 100% of the soap bar is employed thereby preventing waste.

4 Claims, 1 Drawing Sheet

SOAP GRIP FOR BATHING

BACKGROUND OF THE INVENTION

It has long been a problem in the past to lather the body properly and efficiently when bathing either in a shower or a tub. The bar of soap is slippery and of different shapes and sizes presenting a problem in application to different parts of the body and preventing the soap from slipping from the grasp.

Further, the provision of proper lathering has presented a problem. It has been difficult to provide sufficient soap lather to all parts of the body to complete the cleansing action.

Further, the accidental dropping of the bar can create great aggravation both in the shower and the tub. Hunting the elusive bar has been encountered by all users at one time or another. Various attempts have been made to increase the efficiency of the lathering operation such as by soap mitts fitting the hand and a bar of soap. However, there has remained the problem of providing a truly efficient means for retaining a bar of soap and providing efficient lathering and ease of application while lathering.

SUMMARY OF THE INVENTION

By means of this invention there has been provided a soap grip for bathing which holds a bar of soap and provides a fabric container with flaps which facilitates lathering or sudsing and retention of the soap bar in the bathing operation.

The soap grip is formed of two separate panels of fabric or cloth which are seamed together in a generally U-shaped to form a pocket or sock open at the top of the U into which the bar of soap is inserted. The two panels extend separately and unconnected beyond the exterior of the pocket in the form of loose flaps. The entire structure is simply handled in the bathing operation whether in a tub or shower. The soap grip is easily gripped in a manner to avoid slippage and accidental dropping. Should the soap grip be dropped for one reason or another, it is easily located by the flaps since they extend laterally from the pocket a substantial distance which aids not only in the lathering operation but also in finding and grasping the dropped soap grip.

The fabric is preferably formed from a stretchable non-woven polyester felt which is permeable to aid in the lathering operation and also provides for rapid drying after usage. The forming of the pocket seam may be accomplished by a heat seal or stitching as desired. If a heat seal is used to form the seam, it may be continuous or discontinuous to enhance the passage of soapy water from the bar of soap in the pocket to the flaps.

The soap grip of this invention is simply employed and accommodates different shapes and sizes of bars of soap. The efficiency of lathering or sudsing and grasping the bar of soap is greatly facilitated.

The above features are objects of this invention. Further objects will appear in the detailed description which follows and will be otherwise apparent to those skilled in the art.

For purpose of illustration of this invention a preferred embodiment is shown and described hereinbelow in the accompanying drawing. It is to be understood that this is for the purpose of example only and that the invention is not limited thereto.

IN THE DRAWINGS

DESCRIPTION OF THE INVENTION

Figure 1:
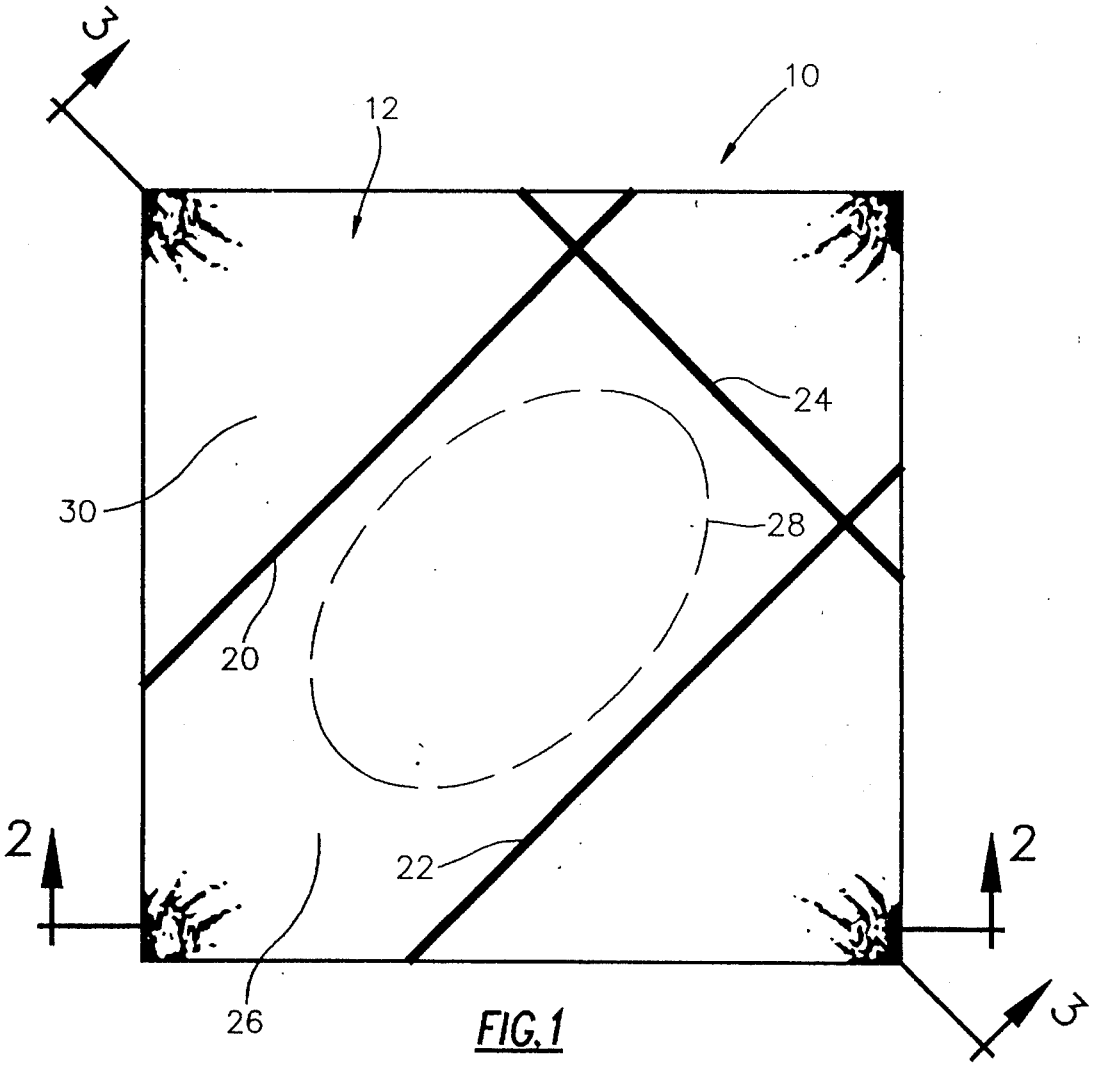
FIG. 1 is a top plan view of the soap grip with the hidden bar of soap shown in dotted lines.

The soap grip of this invention is generally indicated by the reference numeral 10 in FIG. 1. It is comprised of two panels 12 and 14. A pocket or sock compartment 16 is provided by a generally U-shaped seam 18 having opposite legs 20 and 22 connected by a bottom bight portion 24.

Figure 3:
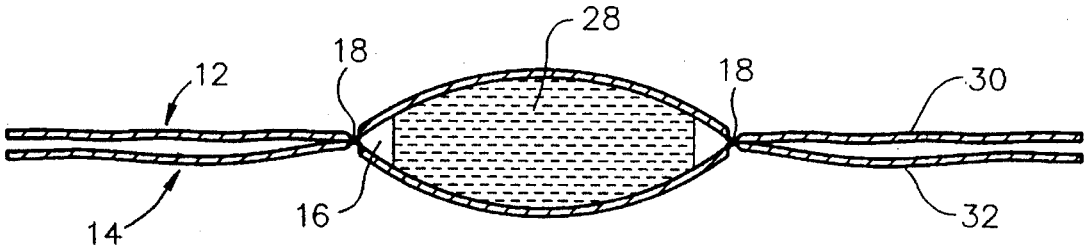
FIG. 3 is a view in section taken on line 3—3 of FIG. 1.

The pocket 16 has an opening 26 which snugly receives a bar of soap 28 as best shown in FIGS. 1 and 3. The U-shaped seam 18 forming the pocket 16 may be in the form of a continuous or discontinuous seal or stitching as desired.

The two panels 12 and 14 are provided with flaps which extend laterally from the seam a substantial distance, as for example, about the width of the pocket 16. This is to provide further surface for sudsing or lathering for use of the bather and to provide additional surface for locating and grasping the soap grip when accidentally dropped.

Figure 2:
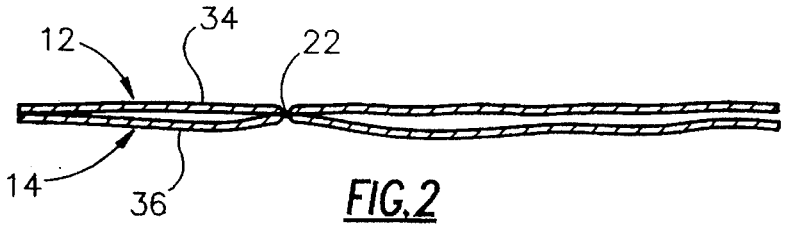
FIG. 2 is a view in section taken on the line 2—2 of FIG. 1.

The panels 12 and 14 may be in various shapes to provide the pocket 18 and flaps. A preferred configuration is that of a square for ease in fabrication and efficiency in function of the soap grip. As shown in FIGS. 1, 2 and 3 the panel 12 has a peripheral flap generally indicated by the reference numeral 30 extending around the pocket while panel 14 has a similar flap 32. The flaps are not connected together except at the seam and are free to move separately which aids in the efficiency of the lathering operation. Also, because of the square configuration of the two panels, tabs 34 and 36 are formed in the panels 12 and 14 as extensions of the pocket 16. This not only aids in the lathering operation but serves as an aid in pulling open the pocket for inserting and withdrawing the bar of the soap.

The panels 12 and 14 are desirably made of a fabric that is stretchable and is permeable for passage of soapy water from the pocket 16 throughout the soap grip and flaps 30 and 32 and can be easily dried. Such a fabric has been found and used preferably as a stretchable, non-woven polyester felt. As an example, such material is A-3000 supplied by Richmond Aircraft Products of Norwalk, Calif. This material is soft and dryable, easily conforming to different contours and a highly efficient permeable bleeder and breather permitting the passage of soapy water throughout the panels. Further, it may be easily heat sealed to form the seam 18 in a continuous U-shaped seam as shown in FIG. 1 or in discontinuous or dotted line form to enhance the distribution of soapy water from the pocket 16 to the flaps 30 and 32.

USE

The soap grip is simply employed by inserting a bar of soap in the pocket 16 as shown in FIG. 3. The stretch of the fabric permits various sized and shaped bars to be inserted. As the bar of soap is deplenished to a sliver, it is still retained to exhaustion in the pocket and the inconvenience of use or waste of such a sliver is avoided. Also a fresh bar of soap may be added to the sliver due to the stretchability of the fabric and particularly when the polyester felt is employed.

The sudsing and lathering operation is effected by wetting the soap grip and bar and applying to various parts of the body with the flaps 30 and 32 enabling easy access to difficult areas to reach such as the back and feet. After use, the soap grip may be rinsed and easily dried for further use with the bar of soap retained in the soap grip or removed according to the user's desire.

The soap grip of the invention not only contains or sandwiches the bar of soap to provide a good grip to prevent the bar from slipping from the fingers but is easy to locate through the easily accessible flaps should the grip fall to the bottom of the tub or shower. While many materials may be used for the fabric, the stretchable non-woven polyester felt has important qualities not found in many fabrics. The polyester felt has the right feel, good sudsing, is non-allergenic, resistance to mildew and good drapeability to accommodate different bars and shapes. Free flow of soapy water or suds occurs through the polyester felt.

The material used in this invention is used in industry where it is required that air must flow through a fabric when that fabric is under high pressure. This free flow characteristic allows the soap to suds freely and flow through the entire volume of the polyester felt.

Various changes and modifications may be made within this invention as will be apparent to those skilled in the art. Such changes and modifications are within the scope and teaching of this invention as defined in the claims appended hereto.

What is claimed is:

1. A reusable soap holder and grip for use in sudsing and lathering by a user while bathing, said holder being comprised of separate integral first and second panels of cloth positioned in overlying relation, a seam connecting the panels together in a generally U-shaped seam to provide a pocket closely receiving a bar of soap, said first and second panels extending outwardly around said seam to form disconnected and separate flaps extending from each of said panels, said flaps being completely free on exterior edges, said panels having a porous quality to promote sudsing and lathering from the bar of soap inside the pocket when wetted, the cloth being comprised of stretchable non-woven polyester felt, the seam being formed by a heat seal of the polyester felt and said pocket being stretchable to receive various sizes of bars of soap.

2. The soap grip of claim 1 in which the seam connects the first and second panels along the seam while permitting the passage of soapy water from the pocket to the flaps exteriorly of the seam.

3. The soap grip of claim 1 in which the two panels are square and the U-shaped seam has an opening at a corner of said square and a bottom bight portion spaced from and extended across an opposite corner of said square.

4. The soap grip of claim 3 in which said flaps extend laterally from said pocket a distance substantially equal to the width of said pocket.

* * * * *